United States Patent [19]

Singleton

[11] Patent Number: 4,593,583

[45] Date of Patent: Jun. 10, 1986

[54] TORQUE TOOL ADAPTED TO SET A FASTENER AND TO SECURE AND RETAIN FASTENER FRAGMENTS

[75] Inventor: Arthur M. Singleton, Dunwoody, Ga.

[73] Assignee: Hi-Shear Corporation, Torrance, Calif.

[21] Appl. No.: 436,591

[22] Filed: Oct. 25, 1982

[51] Int. Cl.[4] ..... B25B 17/00

[52] U.S. Cl. ..... 81/57.14; 81/55; 81/57.3; 81/124.3

[58] Field of Search ..... 81/55, 56, 121 B, 124.1, 81/57.3, 57.14, 54, 431; 72/391

[56] References Cited

U.S. PATENT DOCUMENTS

| | | | |
|---|---|---|---|
| 2,705,896 | 4/1955 | Holmes | 81/57.14 |
| 2,930,267 | 3/1960 | Apicelli | 81/124.1 |
| 3,041,902 | 7/1962 | Wing | 81/56 |
| 4,275,583 | 6/1981 | Gilbert et al. | 72/391 |

*Primary Examiner*—James L. Jones, Jr.

*Attorney, Agent, or Firm*—Donald D. Mon; David O'Reilly

[57] ABSTRACT

A torque tool for applying torque to set a frangible threaded fastener, and to secure and retain detached fastener fragments. The tool drives a hollow spindle and drive socket to which is connected conduitry that leads to suction means such as a vacuum cleaner, whereby the drive socket provides means both for driving the fastener and for securing and retaining fastener fragments and other detritus.

6 Claims, 2 Drawing Figures

TORQUE TOOL ADAPTED TO SET A FASTENER AND TO SECURE AND RETAIN FASTENER FRAGMENTS

FIELD OF THE INVENTION

This invention relates to a tool for setting frangible torque-limiting threaded fasteners, which tool secures and retains fastener fragments which it has caused to come loose from the installed fastener.

BACKGROUND OF THE INVENTION

Certain types of torque-limited threaded fasteners are driven by means of a driving section up to a predetermined torque. When this torque is applied, the driving section breaks loose, usually by shear fracture at a section designed for this purpose, and the driving section comes loose. This leaves the remainder of the fastener, usually in the nature of a threaded nut, threaded onto a stud or bolt at the predetermined torque. A well-known fastener of this general type is shown in George S. Wing U.S. Pat. No. 2,940,495 issued June 14, 1960. This fastener is made and sold under the trademark "Hi-Lok" by Hi-Shear Corporation of Torrance, Calif.

A problem encountered in the shop with the fasteners of this class is that of securing and retaining the fastener fragment which has come loose from the remainder of the fastener. In open work where there is good access, this is not an appreciable problem, but in close quarters it can be troublesome to collect all of the drive sections which have broken loose. Accordingly, it is an object of this invention to provide a tool which can be utilized to set the fastener to its predetermined torque and when the drive section comes loose, to secure and retain it.

It is another object of this invention to provide a tool which can be used for additional cleanup purposes around the workpiece.

BRIEF DESCRIPTION OF THE INVENTION

A tool according to this invention is provided with a socket or other torque-applying adapter means adapted to engage with the fastener which is to be driven. This adapter has a hollow center adapted to engage the drive section of the fastener, and to carry it away when it breaks loose. The adapter is driven by motor means so as to exert torque, and is connected to conduit means which in turn is connected to a source of vacuum which will draw the fragment through the adapter and into a receptacle.

The invention will be fully understood from the following detailed description and the accompanying drawings, in which:

DETAILED DESCRIPTION OF THE INVENTION

Figures 1, 2:
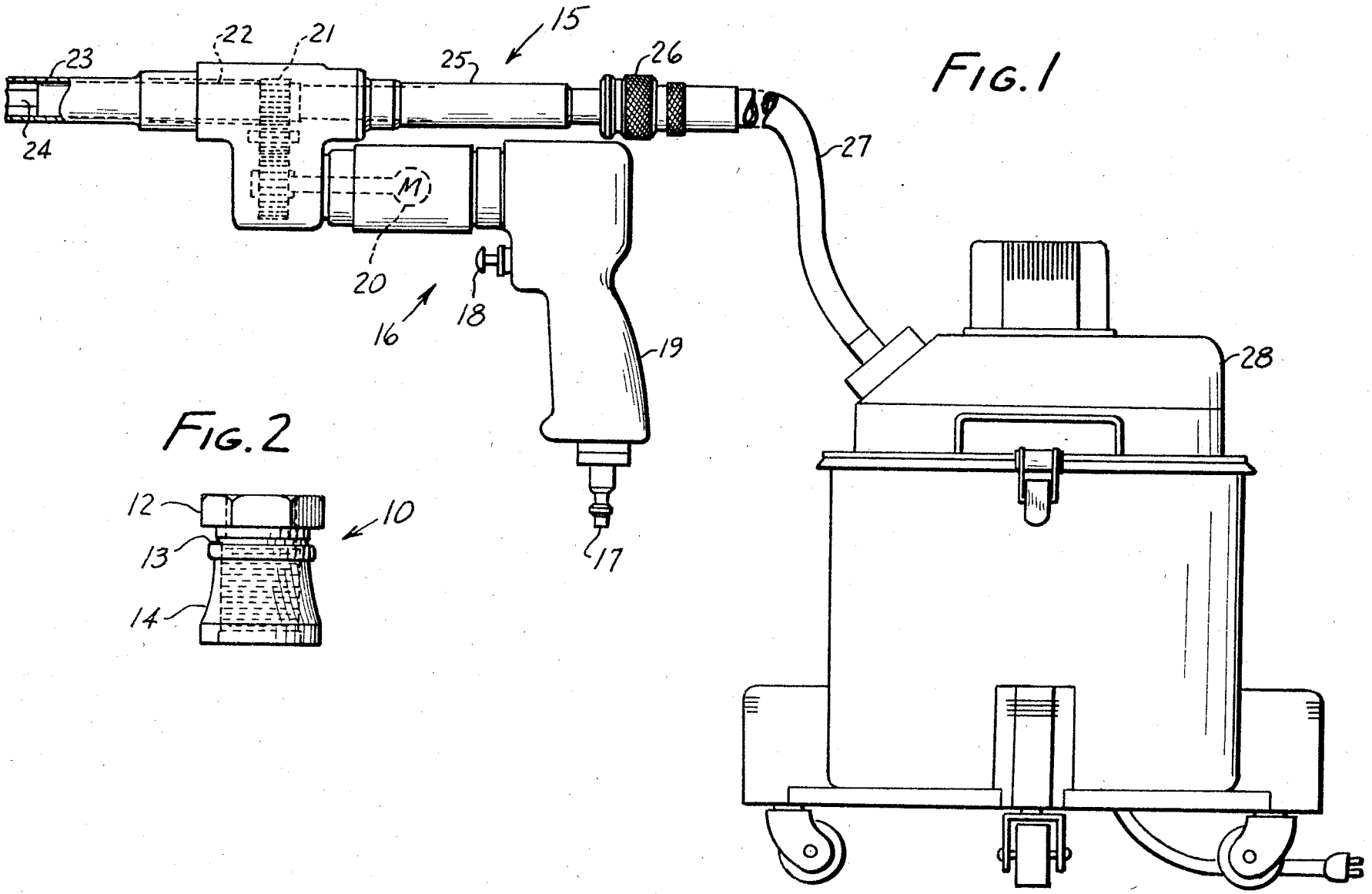
FIG. 1 is a side elevation partly in cutaway and partly in schematic notation, showing the presently preferred embodiment of the invention.
FIG. 2 is a side view of a fastener of a type adapted to be driven by the illustrated tool.

The purpose of the tool according to this invention is to drive fasteners typified by fastener 10 shown in FIG. 2. There is illustrated a fastener described in said Wing U.S. Pat. No. 2,940,495, which patent is incorporated herein by reference in its entirety. Briefly stated, this fastener includes a threaded collar portion 14, a hexagonal drive section 12, and a reduced shear section 13. When the fastener is threaded onto a pin or bolt and brought against a workpiece, torque will be applied to the threaded collar portion which is communicated through the shear section to the collar portion 14. When the predetermined torque, which is a function of the cross-section area at shear section 13, is reached, then the fastener will fracture at the shear section and the drive section will come loose. This leaves the collar portion set to the predetermined torque on the threaded pin or bolt. It is the object of this invention to provide a tool which secures and retains the detached drive section.

Hollow-spindle drives for the purpose of supplying fasteners for repetitive applications are known. One such is shown in Bochman U.S. Pat. No. 2,927,491, issued Mar. 8, 1960, and this patent is incorporated herein by reference in its entirety to show means for driving a hollow spindle, and for connecting an air-conduit to the spindle. However, in the Bochman patent, air pressure is applied to a plunger in a conduit to supply a succession of such fasteners, and the inevitable result is the expulsion of the fragments, rather than their retention. It is the object of this invention to collect and retain parts, rather than to expel them.

A tool 15 according to this invention for this purpose is shown in FIG. 1. It includes a conventional air motor 16 ("power means") with a nipple 17 adapted for connection to a source of compressed air for power purposes, and a trigger 18 to control the application of power. The trigger is located adjacent to handle 19. An air motor 20 is housed in a case attached to the handle. It drives a drive gear 21 which, through an appropriate gear train, makes side engagement with gear teeth on the outside of a hollow drive spindle 22.

Drive spindle 22 is adapted to mount and drive a drive socket 23 which also is hollow and aligned with the spindle. A hexagonal array of driving surfaces 24 is formed at the end of the drive socket for the purpose of engaging the drive section of the fastener. It will now be seen that rotation of the air motor will cause rotation of the drive socket so as to rotate and set the fastener. As stated, the drive socket and drive spindle are hollow. They make fluid connection with a conduit 25 and a hose connector 26 that connects to a hose 27 which, in turn, is connected to suction means 28 such as a conventional vacuum cleaner. When the vacuum cleaner is turned on to generate its suction, it exerts a vacuuming effect through the hose, conduit spindle, and the drive socket to the end of the drive socket, which draws fastener fragments and detritus into and through the socket, spindle and conduit.

When the tool is used, it is customary for the fastener already to have been partially tightened, perhaps finger-tight, down onto its pin. The tool is then applied to the drive section and the trigger is pressed. Rotation of the drive socket will apply torque to the fastener and ultimately will exert sufficient torque to cause fracture at the shear section. At this time the vacuum exerted by the vacuum cleaner will suck the detached drive section through the socket, spindle and hose to the receptacle (not shown) in the vacuum cleaner. Thus, this tool has both applied the desired torque to set the fastener and has secured and retained the fastener fragment which application of the correct torque has detached.

As an additional useful feature, dust, shavings and other fragments can be vacuumed up around the work by using the tool as a typical vacuum cleaner nozzle, pulling in the other fragments and detritus in a conventional "vacuuming" manner.

It will now be seen that this tool provides a useful means for keeping the work area clean of fragments, and of other detritus generated in other processes.

This invention is not to be limited by the embodiment shown and the drawings and described in the description, which is given by way of example and not of limitation, but only in accordance with the scope of the appended claims.

I claim:

1. A torque tool for applying torque to set a frangible threaded fastener which fastener when set by the tool yields a detached fastener fragment, and to secure and retain said detached fastener fragment, said tool comprising: a torque-applying socket with a driving end, said socket having at its driving end an open-ended internal array of fastener-engaging surfaces adapted to receive and engage the portion of the fastener comprising said fragment, and an internal passage extending into and away from said array; a drive spindle to which said socket is attachable in order to be driven by said spindle, and an internal passage through said spindle connected to said internal passage; power means drivingly connected to said spindle to rotate said spindle; conduit means fluidly connected to said internal passage of said spindle; and suction means fluidly connected to said conduit, whereby detached fastener fragments are drawn from said drive socket into and through said internal passages and said conduit means by suction exerted by said suction means.

2. Apparatus according to claim 1 in which said power means is a rotary motor.

3. Apparatus according to claim 2 in which said power means is a rotary compressed air-powered motor.

4. Apparatus according to claim 2 in which said motor drives said spindle from its side.

5. Apparatus according to claim 1 in which said suction means comprises a vacuum cleaner.

6. Apparatus according to claim 1 in which said suction means operates continuously, and said socket can be used as the nozzle of a suction cleaner.

* * * * *